US005495326A

United States Patent [19]

Mikida

[11] Patent Number: 5,495,326

[45] Date of Patent: Feb. 27, 1996

[54] SHEET FEEDING CONTROL FOR AN IMAGE FORMING APPARATUS

[75] Inventor: Toshiyuki Mikida, Anpachi, Japan

[73] Assignee: Sanyo Electric Co., Ltd., Moriguchi, Japan

[21] Appl. No.: 8,887

[22] Filed: Jan. 25, 1993

Related U.S. Application Data

[63] Continuation of Ser. No. 874,063, Apr. 24, 1992, abandoned.

[30] Foreign Application Priority Data

Apr. 26, 1991 [JP] Japan ..... 3-97492

[51] Int. Cl.[6] ..... G03G 21/00

[52] U.S. Cl. ..... 355/309; 271/110; 271/265.01

[58] Field of Search ..... 355/308, 309, 355/208, 316, 321, 311; 271/9.02, 110, 111, 265.01, 265.02, 9.01

[56] References Cited

U.S. PATENT DOCUMENTS

| | | | |
|---|---|---|---|
| 4,428,663 | 1/1984 | Ito et al. | 355/309 |
| 4,589,765 | 5/1986 | Perun et al. | 355/309 |
| 5,130,724 | 7/1992 | Crowley | 355/316 X |
| 5,142,323 | 8/1992 | Iwamoto | 271/9.02 X |
| 5,221,949 | 6/1993 | Miyamoto | 355/309 |
| 5,423,527 | 6/1995 | Tranquilla | 271/111 X |

FOREIGN PATENT DOCUMENTS

| | | | |
|---|---|---|---|
| 0376112 | 7/1990 | European Pat. Off. | 355/316 |
| 0404418 | 12/1990 | European Pat. Off. | 355/309 |
| 58-104856 | 6/1983 | Japan | 271/110 |
| 58-173759 | 10/1983 | Japan | 355/309 |
| 3-087847 | 4/1991 | Japan | 355/309 |

*Primary Examiner*—A. T. Grimley
*Assistant Examiner*—Shuk Y. Lee
*Attorney, Agent, or Firm*—Darby & Darby

[57] ABSTRACT

An image forming apparatus for forming an image on a sheet supplied thereto, wherein a time period required for a first sheet passing a predetermined position in a sheet conveying path is measured, and the measured time period is compared with a previously set time period. The sheet supply operation is controlled so that, when the measured time period is shorter than the set time period, operations of supplying second and subsequent sheets are started with a time interval equal to the difference between the time periods, and, when the measured time period is equal to or longer than the set time period, operations of supplying second and subsequent sheets are started immediately.

9 Claims, 5 Drawing Sheets

SHEET FEEDING CONTROL FOR AN IMAGE FORMING APPARATUS

This is a continuation of application Ser. No. 07/874,063, filed Apr. 24, 1992, now abandoned.

BACKGROUND OF THE INVENTION

1. Field of the Invention

This invention relates to an image forming apparatus in which sheets are conveyed from a sheet supplying unit along a sheet conveying path and an image is formed thereon, and particularly to an improvement in the timing of supplying sheets from the sheet supplying unit.

2. Description of the Related Art

Conventionally, in a conveyance unit for conveying sheets along a sheet conveying path, when the size of a sheet cannot be detected, the timing of supplying sheets from a sheet supplying unit included in the conveyance unit is determined according to one of the three methods described below.

In a first method, the sheet supply operation is started after the previous sheet has passed through the final process. In accordance with the detection output of a sensor disposed in the vicinity of the place where the final process is conducted, it is determined whether or not the previous sheet has passed through the final process. Alternatively, the time period extending between the beginning of the sheet supply operation and the end of the final process is previously set on the basis of experience, and, when the set time period has elapsed, it is determined that the previous sheet has passed through the final process. In a case where a transfer material is toner, the final process with respect to the conveyance of sheets is a fixing process or a sheet discharge process. According to the first method, the sheet supply operation is conducted one by one for each of sheets irrespective of the size of the sheet to be supplied.

In a second method, the time period is previously measured which is required for a sheet of the maximum size on which an image can be formed by the apparatus passing through a given position. The sheet supply operation is started at the interval of the thus measured time period, irrespective of the size of the sheet to be supplied. Accordingly, when the image formation is carried out on the sheet of the maximum size, the sheet supply operation is sequentially started, but, when the image formation is carried out on the sheets the sizes of which are smaller than the maximum size, the operation of supplying the next sheet is started after a predetermined waiting period has elapsed. In this context, the waiting period is equal to the difference between the measured time period for the sheet of the maximum size and the time period required for the sheets of the smaller sizes passing through the given position.

In a third method, when both the front and rear edges of the previous sheet have been detected by a sensor, the operation of supplying the next sheet is started. In the sheet conveyance according to the third method, the number of sheets conveyed into the sheet conveying path of the body of the apparatus is inversely proportional to the sizes of the sheets. During a given time period, hence, sheets of a small size are conveyed in an increased number, and in contrast those of a large size are conveyed in a reduced number.

Since the sheet supply operation is started irrespective of the size of the sheet to be supplied, the first and second methods have a defect that the sheet conveying operation and the image forming operation which corresponds thereto are slow. Particularly, this defect is remarkable when sheets of a small size are used.

In the third method, the sheet supply operation varies in speed according to the sizes of sheets to be supplied, and therefore, even when sheets of a small size are to be supplied, there appears no defect that the image forming operation is slow. However, the third method suffers from another defect that, when the operation of an apparatus is stopped because of any cause, a number of sheets remain in the sheet conveying path of the body of the apparatus to be removed, and it is cumbersome to remove the remaining sheets and these sheets are wasted.

SUMMARY OF THE INVENTION

It is an object of the invention to provide an image forming apparatus in which the timing of starting the sheet supply operation that leads to an efficient sheet conveyance can be set, thereby allowing the sheet conveyance to be rapidly conducted.

It is another object of the invention to provide an image forming apparatus in which it is prevented from occurring that a number of sheets exist at a time in the sheet conveying path of the body of the apparatus, so that, even when the forming operation of the apparatus is stopped during a continuous image forming operation, the waste of sheets can be suppressed to a minimum.

According to the image forming apparatus of the invention, a time period required for a first sheet passing a predetermined position in a sheet conveying path is measured, and the measured time period is compared with a previously set time period. Depending upon the comparison result, the timing of starting the operation of supplying second and subsequent sheets is determined. When the measured time period is shorter than the set time period, operations of supplying second and subsequent sheets are started with an interval equal to the difference between the time periods. This case where the measured time period is shorter than the set time period corresponds to a case where sheets of a small size are conveyed. Hence, the provision of the interval in the sheet supply operation prevents a number of sheets from existing at a time in the sheet conveying path. Even if the operation of the apparatus is stopped, therefore, the waste of sheets can be suppressed to a minimum. On the other hand, when the measured time period is equal to or longer than the set time period, operations of supplying second and subsequent sheets are started immediately. Since this case where the measured time period is equal to or longer than the set time period corresponds to a case where sheets of a large size are conveyed, the immediate start of operations of supplying second and subsequent sheets causes the conveying operation to be conducted effectively as compared with the prior art.

The above and further objects and features of the invention will more fully be apparent from the following detailed description with accompanying drawings.

DESCRIPTION OF THE PREFERRED EMBODIMENTS

The invention will be described with reference to the drawings illustrating embodiments.

Figure 1:
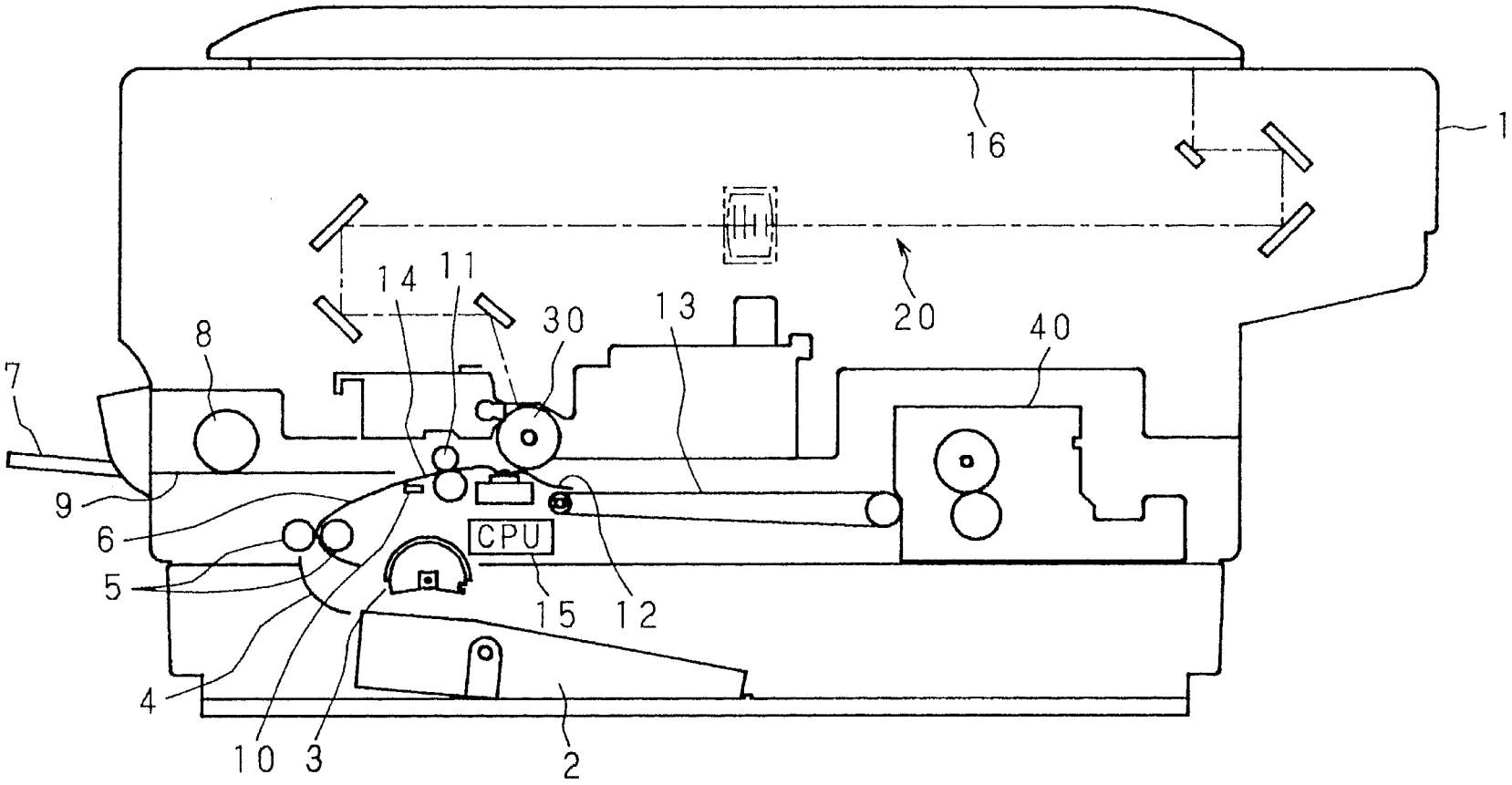
FIG. 1 is a sectional view illustrating an image forming apparatus according to the invention.

FIG. 1 is a sectional view illustrating an image forming apparatus according to the invention. In the figure, portions characteristic of the invention are shown in detail. At the upper surface of the body 1 of the apparatus, a document table 16 made of glass is disposed. An original placed on the document table 16 is scanned by an optical system 20 which consists of optical devices such as an exposure lamp, mirrors and lenses, so that an image of the original is formed on a photosensitive drum 30 as an electrostatic latent image. At the surrounding of the photosensitive drum 30, arranged are a charger for uniformly charging the photosensitive drum 30, a development device for developing the latent image into a toner image, a transfer charger for transferring the toner image onto a sheet, a separation charger for separating the sheet from the photosensitive drum 30, a cleaning device for removing toner remaining on the photosensitive drum 30, an eraser lamp for eliminating residual charges on the photosensitive drum 30, etc.

A sheet supply cassette 2 for accommodating sheets is disposed at the lower portion of the body 1. In the vicinity of the sheet supply cassette 2, a cassette sheet supply roller 3 having a semicircular section is disposed to feed a sheet accommodated in the sheet supply cassette 2 into a first cassette sheet supply path 4. The first cassette sheet supply path 4 is connected to a second cassette sheet supply path 6, and conveying rollers 5 for conveying a sheet are disposed in the vicinity of the connecting portion of the two paths. A manual sheet supply tray 7 on which sheets to be manually supplied are stacked is disposed on one side of the body 1 so that sheets on the manual sheet supply tray 7 are fed one by one by a manual sheet supply roller 8 into a manual sheet supply path 9. The second cassette sheet supply path 6 and the manual sheet supply path 9 join with each other to form a sheet supply path 14 which is provided with a sensor 10 for detecting the presence of a sheet and resist rollers 11 for aligning the front edge of a sheet. After the front edge of a sheet conveyed into the sheet supply path 14 is aligned by the resist rollers 11, a toner image is transferred from the photosensitive drum 30 to the sheet. The sheet on which the toner image has been transferred is sent through a transfer path 12 and a conveying belt 13 to a fixing device 40 to be subjected therein to the fixing process. A CPU 15 is provided at the substantially center portion of the body 1. The CPU 15 consists of a microcomputer which incorporates a timer for counting time, a RAM for storing measured time period or set time period, etc. and which performs various operations and controls for the image forming apparatus.

Figure 2A:
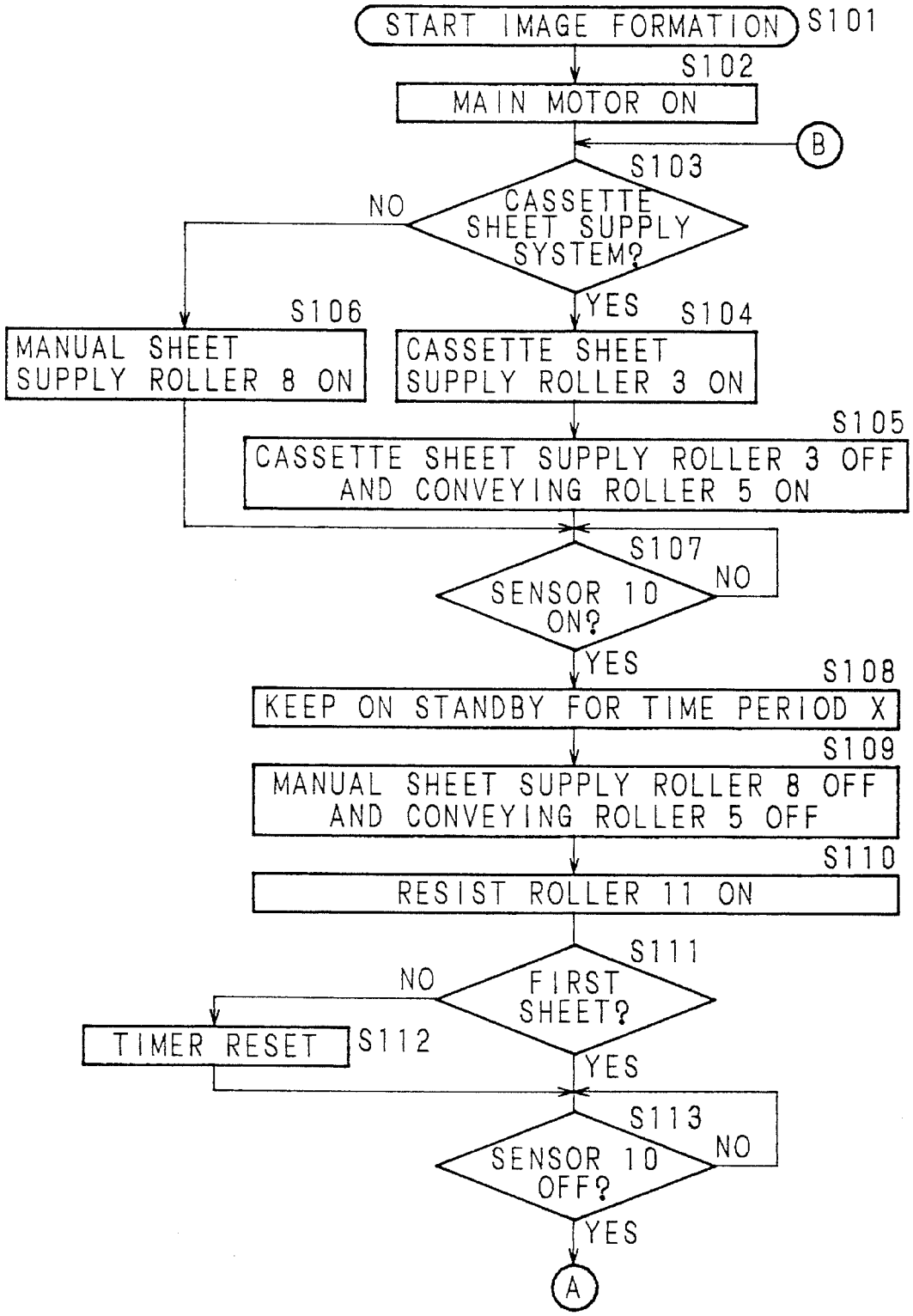
FIGS. 2(*a*) and 2(*b*) are flowcharts illustrating the operation of the image forming apparatus according to the invention.
Figure 2B:
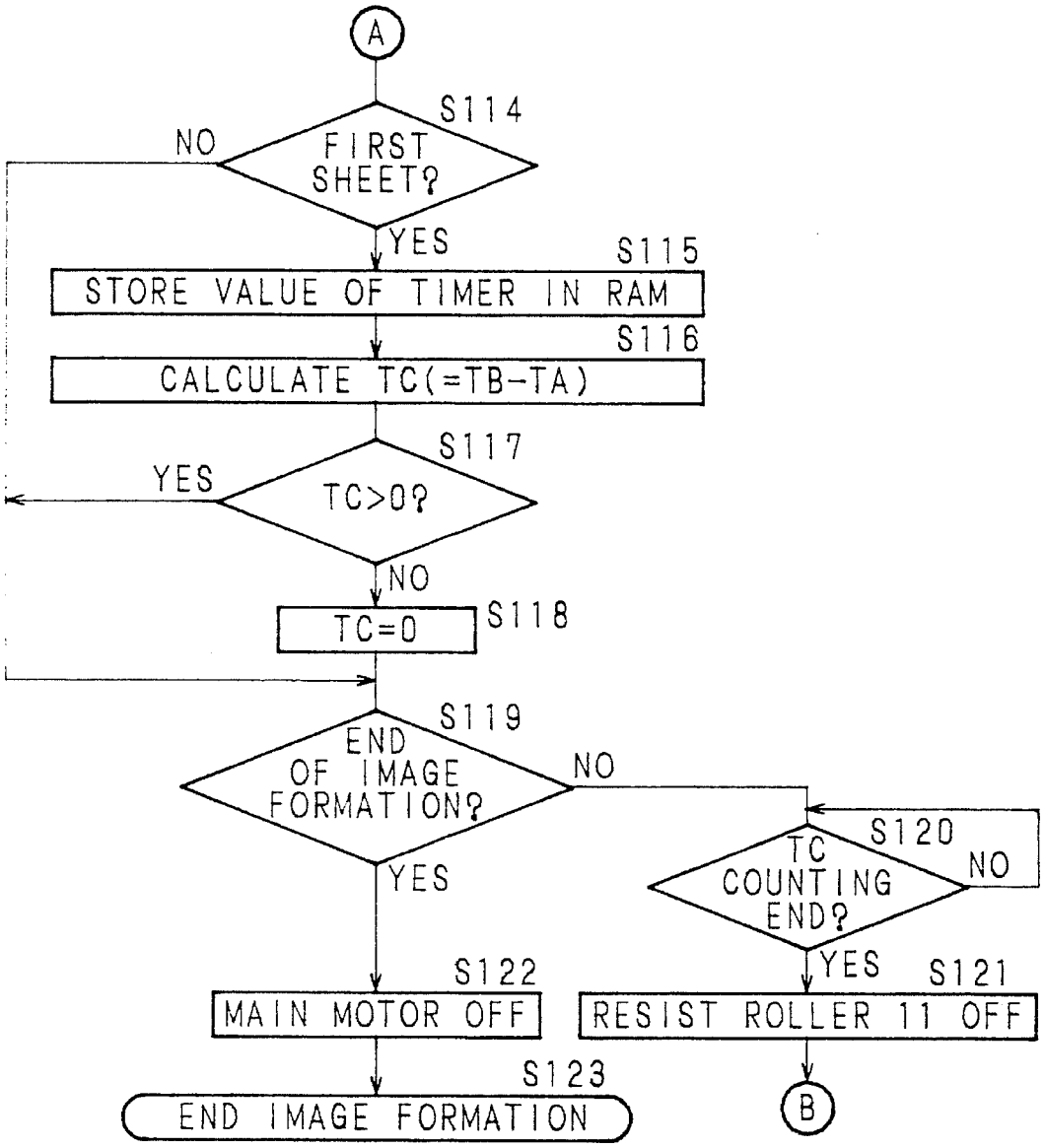
Figure 3:
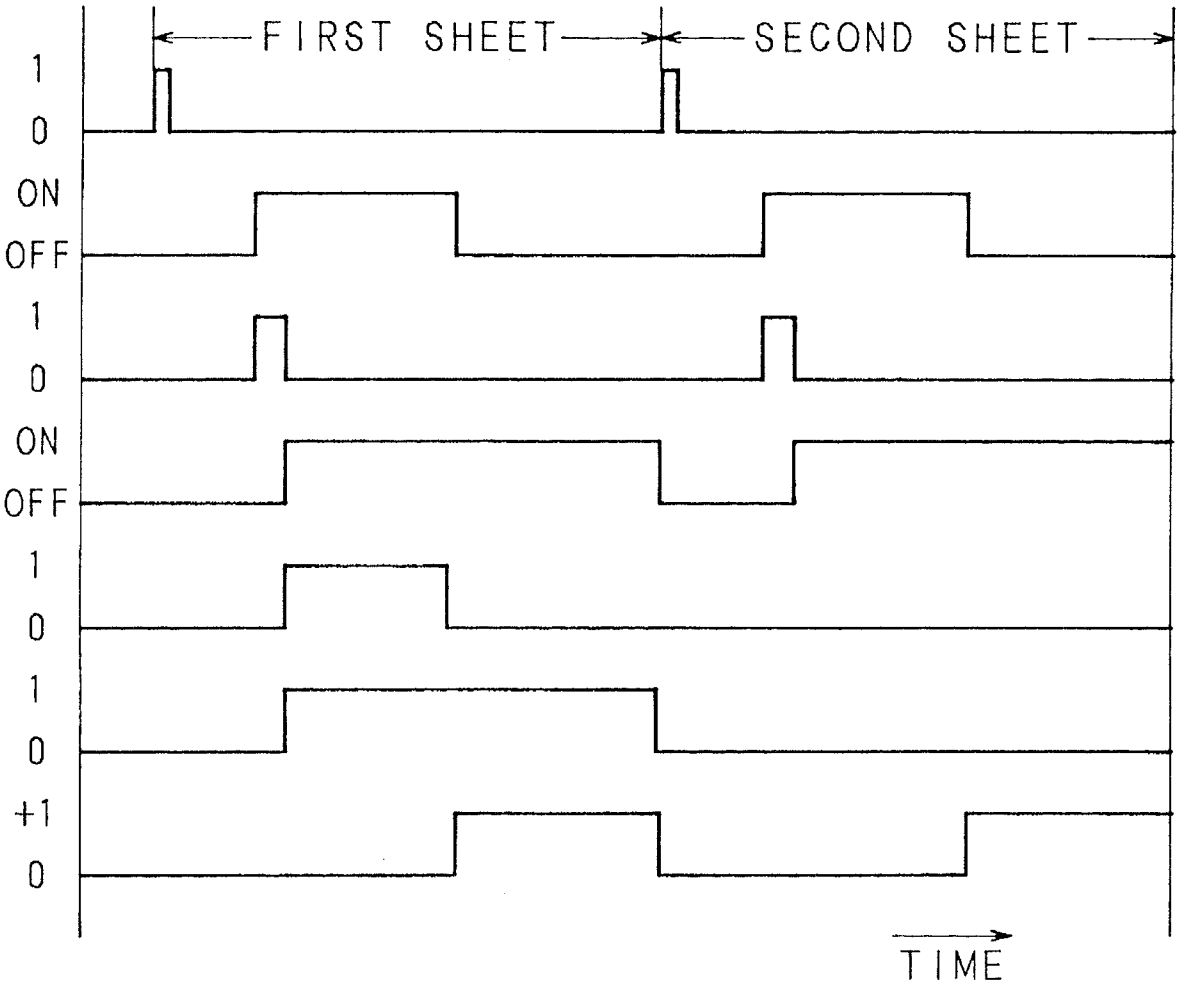
FIG. 3 is a timing chart illustrating the operation conducted when sheets of a small size are conveyed.
Figure 4:
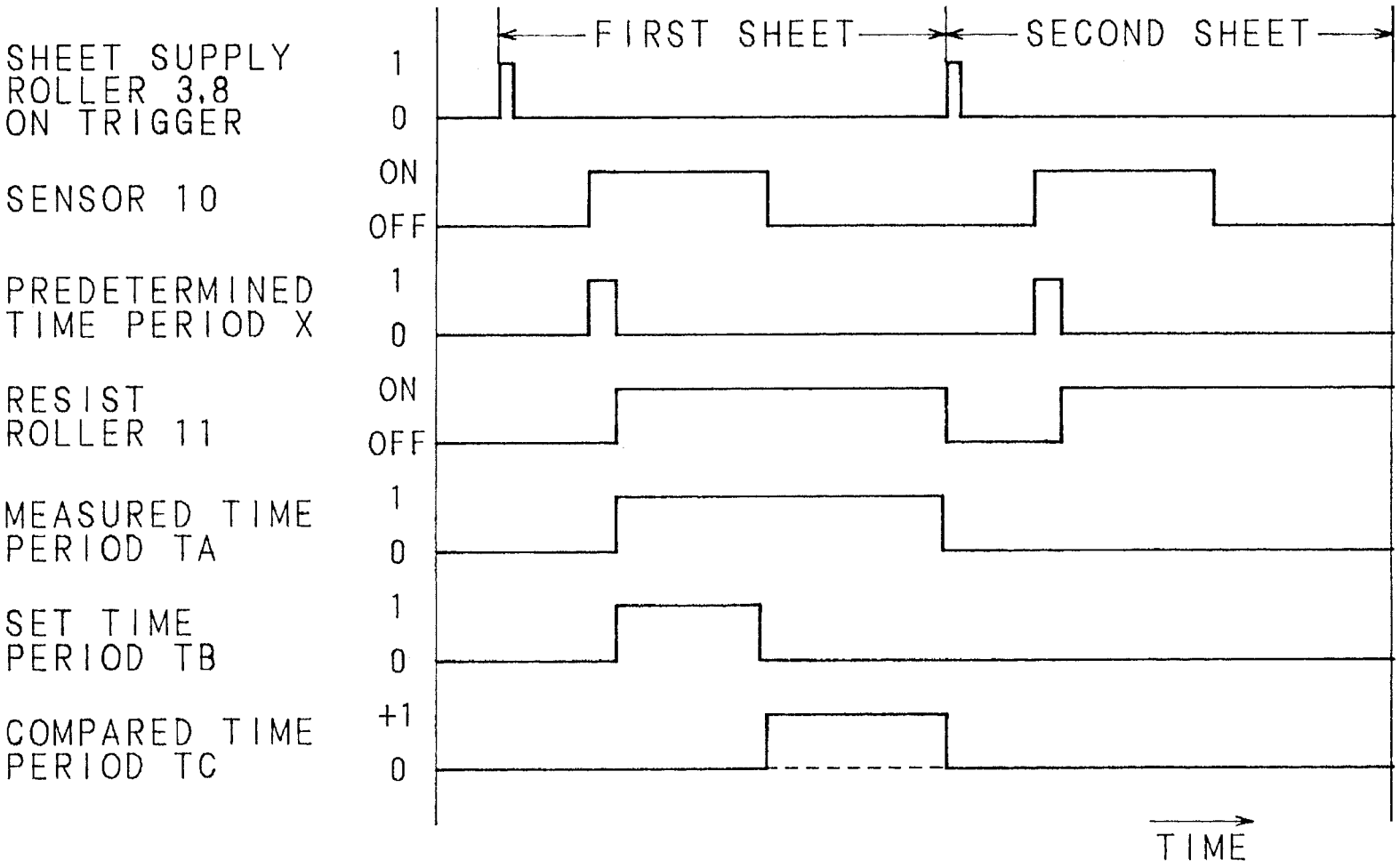
FIG. 4 is a timing chart illustrating the operation conducted when sheets of a large size are conveyed.

The operation of the thus configured image forming apparatus will be described. The following description deals mainly with the operation of conveying sheets in sequence along the sheet conveying path with reference to the flow charts of FIGS. 2(*a*) and 2(*b*) and the timing charts of FIGS. 3 and 4.

When the body 1 is fully ready for the image formation and the command of starting the image formation is issued step (101), a main motor for driving the sheet conveying system starts to drive (step S102). Thereafter, it is judged whether or not the sheet supply system to be activated is the cassette sheet supply system (step S103). If it is the cassette sheet supply system, the judgment is YES and the cassette sheet supply roller 3 begins to be driven (step S104). When a sheet is conveyed along the first cassette sheet supply path 4 toward the conveying rollers 5, the driving operation of the cassette sheet supply roller 3 is stopped and the conveying rollers 5 begins to be driven (step S105). When the front edge of the sheet abuts on the conveying rollers 5, the sheet is directed by the driven conveying rollers 5 to the second cassette sheet supply path 6. If the sheet supply system to be activated is not the cassette sheet supply system in step S103 (i.e., it is the manual sheet supply system), the judgment is NO and the manual sheet supply roller 8 begins to be driven (step S106).

The sheet supplied by the cassette sheet supply system or the manual sheet supply system passes the sheet supply path 14 at the vicinity of the intersection of the prolonged lines of the second cassette sheet supply path 6 and manual sheet supply path 9. It is judged whether or not the sensor 10 which is turned on when detecting the front edge of a sheet and turned off when detecting no sheet is in the ON state (step S107). If no sheet is supplied (i.e., the sensor 10 is in the OFF state), the judgment is NO and the process (step S107) of judging whether or not the sensor 10 is in the ON state is repeated. In contrast, if a sheet is supplied (i.e., the sensor 10 is in the ON state), the judgment is YES and the process advances to the next step. In order to align the front edge of the sheet with the resist rollers 11, the sheet is kept on standby for a predetermined time period X (step S108), and thereafter the driving operation of the manual sheet supply roller 8 is stopped and also the driving operation of the conveying roller 5 is stopped (step S109).

The sheet which has been aligned at the front edge by the resist rollers 11 is caused to be conveyed along the sheet supply path 14, by the start of the driving operation of the resist rollers 11 (step S110), and then a toner image is transferred from the photosensitive drum 30 to the sheet. Thereafter, the sheet is sent via the transfer path 12 and conveying belt 13 to the fixing device 40.

It is judged whether or not an image is to be formed on the first sheet (step S111). It is assumed that in this case the image is to be formed on the first sheet. Since the image is to be formed on the first sheet, the judgment in step S111 is YES, and the timer of the CPU 15 is reset (step S112) and restarts the count operation. It is judged whether or not the sensor is in the OFF state (step S113). If the sensor 10 is in the ON state, the judgment is NO and the process (step S113) of judging whether or not the sensor 10 is in the OFF state is repeated. When the rear end of the sheet passes the sensor 10, the sensor 10 becomes the OFF state. Then, the judgment in step S113 is YES and the process proceeds to the next step.

In the same manner as step S111, it is again judged whether or not an image is to be formed on the first sheet (step S114). Since the image is to be formed on the first sheet, the judgment in step S114 is YES, and the timer of the CPU 15 stops the count operation at the moment when the sensor 10 is judged in the above-described process of step S113 to be in the OFF state. In this way, in cooperation with the sensor 10, the timer measures the time period required for the sheet passing through the predetermined position (the position at which the sensor 10 is installed). The counted value of the timer which has terminated the count operation is the measured time period (TA). This measured time period (TA) is stored in the RAM of the CPU 15 (step S115). Then, the CPU 15 calculates the difference between a set time period (TB) previously stored in the RAM and the measured time period (TA), and the calculation result is stored as the compared time period (TC) in the RAM (step S116).

The set time period (TB) is previously set in the manner described below. When the operation of the body 1 is stopped because of any cause, a plurality of sheets remain in the sheet conveying path of the body 1 to be removed. The set time period (TB) is set on the basis of the number of the sheets remaining in the sheet conveying path in this case and the time period extending from the beginning to the end of the image forming operation in which the image forming operation is not conducted continuously (i.e., it is conducted on only one sheet). In a simple example wherein the number of sheets remaining in the sheet conveying path is x and the time period extending from the beginning to the end of the image forming operation in which the image forming operation is not conducted continuously and conducted on only one sheet is y, the set time period (TB) is y/x (TB=y/x).

It is judged whether or not the value of the compared time period (TC) obtained in step S116 is positive (step S117). If the value of the compared time period (TC) is not positive, the judgment is NO, and the value of the compared time period (TC) is set to zero and this value is stored in the RAM (step S118). After it is judged YES in step S117 or the value of the compared time period (TC) is set to zero in step S118, it is judged whether or not the image forming operation is to be ended (step S119). If the image forming operation is to be ended after being conducted on only one sheet, the judgment is YES, and the driving operation of the main motor is stopped (step S122) and the image forming operation is ended (step S123). By contrast, if the image forming operation is to be conducted continuously, the judgment in step S119 is NO, and the timer restarts the count operation. Then, it is judged whether or not the content of the timer reaches the value of the compared time period (TC) (step S120). If the content of the timer has not yet reached the value of the compared time period (TC), the judgment is NO, and the process in step S120 of judging whether or not the content of the timer reaches the value of the compared time period (TC) is repeated. On the other hand, if the content of the timer reaches the value of the compared time period (TC), the judgment is YES, and the driving operation of the resist rollers 11 is ended (step S121).

Next, the operation of forming the image on the second sheet will be described. When the driving operation of the resist rollers 11 for the first sheet is ended (step S121), the process returns to step S103 in which it is judged whether or not the sheet supply system to be executed is the cassette sheet supply system. The processes of step S103 to step S110 (the driving operation of the resist rollers 11 is started) are conducted in the same manner as those in the image forming operation for the first sheet.

In the process of step S111 for judging whether or not the image is to be formed on the first sheet, the judgment is NO because in this case the image is not formed on the first sheet. It is judged whether or not the sensor 10 is in the OFF state (step S113). If the sensor 10 is in the ON state, the judgment is NO, and the process (step S113) of judging whether or not the sensor 10 is in the OFF state is repeated. When the rear end of the sheet passes the sensor 10, the sensor 10 becomes the OFF state. Then, the judgment in step S113 is YES and the process proceeds to the next step. It is judged whether or not the image is to be formed on the first sheet (step S114). Since the image is not to be formed on the first sheet in this case, the judgment is NO, and then it is judged whether or not the image forming operation is to be ended (step S119). If the image forming operation is to be conducted further, the judgment in step S119 is NO, and then it is judged whether or not the content of the timer reaches the value of the compared time period (TC) (step S120). If the content of the timer has not yet reached the value of the compared time period (TC), the judgment is NO, and the process in step S120 of judging whether or not the content of the timer reaches the value of the compared time period (TC) is repeated. If the content of the timer has reached the value of the compared time period (TC), the judgment is YES, and the driving operation of the resist rollers 11 is ended (step S121). If the image forming operation is to be ended, the judgment in step S119 is YES, and the driving operation of the main motor is stopped (step S122) and the image forming operation is ended (step S123).

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An image forming apparatus in which sheets of unspecified size are conveyed along a sheet conveying path and an image is formed thereon, comprising:

means for conveying sheets along said sheet conveying path;

means for measuring a time period required for a first sheet passing a predetermined position in said sheet conveying path to determine its size;

means for subtracting a measured time period obtained by said measuring means from a set time period to obtain a subtraction value; and means for controlling said conveyance means in such a manner that, when said subtraction value is positive, operations of conveying second and subsequent sheets are started with a time interval equal to said subtraction value, and, when said subtraction value is negative or zero, operations of conveying second and subsequent sheets are started immediately.

2. An image forming apparatus according to claim 1, further comprising means for detecting the presence of a sheet at said predetermined position in said sheet conveying path, wherein said measuring means measures said time period in accordance with a detection result of said detection means.

3. An image forming apparatus according to claim 1, wherein said conveying means includes sheet supply means for supplying sheets to said sheet conveying path.

4. An image forming apparatus according to claim 3, wherein said sheet supply means comprises: a sheet supply cassette for accommodating the sheets; a first sheet supply roller for taking out sheets one by one from said sheet supply cassette; a sheet supply tray on which sheets are placed; and a second sheet supply roller for taking out sheets one by one from said sheet supply tray.

5. An image forming apparatus according to claim 4, wherein said sheet conveying path comprises: a first sheet conveying path through which sheets taken out from said sheet supply cassette are conveyed; a second sheet conveying path through which sheets taken out from said sheet supply tray are conveyed; and a third sheet conveying path which is a common path communicating with said first and second sheet conveying paths.

6. An image forming apparatus according to claim 5, further comprising detection means for detecting the presence of a sheet at a predetermined position in said third sheet conveying path, wherein said measuring means measures said time period in accordance with a detection result of said detection means.

7. An image forming apparatus according to claim 5, wherein said apparatus further comprises a resist roller for aligning a front edge of a conveyed sheet, said resist roller being disposed in said third sheet conveying path.

8. An image forming apparatus in which sheets of unspecified size supplied from sheet supply means are conveyed along a sheet conveying path and an image is formed thereon, comprising:

means for supplying sheets to said sheet conveying path;

means for conveying supplied sheets along said sheet conveying path;

means for measuring a time period required for a first sheet passing a predetermined position in said sheet conveying path to determine its size;

means for comparing a measured time period obtained by said measuring means with a set time period; and means for controlling said sheet supply means in such a manner that, when said measured time period is shorter than said set time period, operations of supplying second and subsequent sheets are started with a time interval equal to the difference between said time periods, and when said measured time period is equal to or longer than said set time period, operations of supplying second and subsequent sheets are started immediately.

9. An image forming apparatus according to claim 8, wherein said sheet supply means comprises: a sheet supply cassette for accommodating sheets; a first sheet supply roller for taking out sheets one by one from said sheet supply cassette; a sheet supply tray on which sheets are placed; and a second sheet supply roller for taking out sheets one by one from said sheet supply tray.

* * * * *